US008544671B2

(12) United States Patent
Cerasani

(10) Patent No.: US 8,544,671 B2
(45) Date of Patent: Oct. 1, 2013

(54) PASTRY CRADLE AND CRADLE/LID COMBINATION

(75) Inventor: Vincenzo S. Cerasani, Winnipeg (CA)

(73) Assignee: IVMA Holdings Company, Vaudreuil, Quebec (CA)

( * ) Notice: Subject to any disclaimer, the term of this patent is extended or adjusted under 35 U.S.C. 154(b) by 233 days.

(21) Appl. No.: 12/781,921

(22) Filed: May 18, 2010

(65) Prior Publication Data

US 2011/0284537 A1 Nov. 24, 2011

(51) Int. Cl.
*B65D 51/18* (2006.01)

(52) U.S. Cl.
USPC ..... 220/212; 220/694; 206/508

(58) Field of Classification Search
USPC ..... 220/380, 712, 711, 254.1, 23.86, 220/23.83, 255.1, 255, 258.3, 258.2, 258.1, 220/623, 608, 700, 699; 206/514, 501, 509; 229/404
IPC ..... B65D 41/56, 51/18, 85/62, 43/03
See application file for complete search history.

(56) References Cited

U.S. PATENT DOCUMENTS 3,061,139 A * 10/1962 Edwards ..... 220/203.09
3,112,841 A * 12/1963 Martinelli ..... 220/380
3,349,941 A * 10/1967 Wanderer ..... 220/23.88
4,074,827 A * 2/1978 Labe, III ..... 220/522
4,202,459 A * 5/1980 DeParales et al. ..... 220/712
4,262,815 A * 4/1981 Klein ..... 220/273
4,438,865 A * 3/1984 Scattaregia ..... 220/270
4,632,271 A * 12/1986 Taylor et al. ..... 220/258.2
5,180,079 A * 1/1993 Jeng ..... 220/705
5,388,729 A * 2/1995 Gerringer ..... 222/130
5,531,347 A * 7/1996 Goulding ..... 220/212
5,743,423 A * 4/1998 Franco ..... 220/23.86
D417,845 S * 12/1999 Sadlier et al. ..... D9/447
6,070,752 A * 6/2000 Nava et al. ..... 220/521
6,260,727 B1 * 7/2001 Durdon ..... 220/254.3
6,427,864 B1 * 8/2002 Asselin ..... 220/709
6,474,494 B1 * 11/2002 Miller ..... 220/379
6,706,297 B1 * 3/2004 Toth et al. ..... 426/120
6,708,735 B1 * 3/2004 Kenihan ..... 141/18
6,766,902 B1 * 7/2004 Hartelius ..... 206/217
6,942,832 B2 * 9/2005 Mazzarolo ..... 264/553
7,210,577 B2 * 5/2007 Swayne ..... 206/308.1
7,217,434 B1 5/2007 Loh et al.
7,341,754 B1 3/2008 Loh et al.
2003/0034352 A1 * 2/2003 Griffin ..... 220/912
2005/0167294 A1 * 8/2005 Swayne ..... 206/217
2005/0236413 A1 * 10/2005 Maciag et al. ..... 220/256.1
2011/0210126 A1 * 9/2011 Vovan ..... 220/574

* cited by examiner

*Primary Examiner* — Robert J Hicks
(74) *Attorney, Agent, or Firm* — Young Basile Hanlon & MacFarlane PC

(57) ABSTRACT

A bowl-shaped molded plastic cradle has bottom contours which are complemental to the topographical features of a thermoformed drink cup lid so that the cradle and lid may be nested within one another in a laterally stable association. This allows a food product such as a donut to be placed within the tray and marketed with, for example, hot coffee in a synergistic association.

12 Claims, 5 Drawing Sheets

PASTRY CRADLE AND CRADLE/LID COMBINATION

FIELD OF THE INVENTION

This invention relates to disposable drink cups and more particularly to a food product cradle designed for laterally stable, nestable association with a thermoformed drink cup lid.

BACKGROUND OF THE INVENTION

It is well known to use thermoformed thin gauge plastic lids in combination with paper and plastic cups to dispense drinks, such as coffee, soft drinks and cocoa. Such lids come in a number of configurations, many including tear-back, fold-back and/or lock-back tabs for drink-through utilization. A common characteristic of such lids is a topography which features circular or annular steps between multiple topographical levels. See, for example, U.S. Design Pat. No. 417,845, U.S. Pat. No. 6,260,727, U.S. Pat. No. 4,438,865 and U.S. Pat. No. 4,202,459.

Such lids are often thermoformed of thin gauge, extruded plastic sheet material, often in a single or continuous operation such as described in U.S. Pat. No. 6,942,832 issued Sep. 13, 2005. Suitable materials include polystyrene, polypropylene, polyethylene and others.

SUMMARY OF THE INVENTION

In a first aspect, the invention described herein comprises a cradle, tray or bowl, preferably thermoformed from thin gauge plastic material similar or identical to that used to make hot and cold drink cup lids, which bowl, tray or cradle has a bottom with multiple level topographical features which are complemental to at least some degree of the topographical features of a drink cup lid so as to be nestable with the lid in such a way as to produce lateral stability. In the preferred form, the bowl, tray or cradle is annular and has a sidewall of sufficient depth as to conveniently but securely hold a food product such as a donut. In this specification, the terms "bowl", "cradle" and "tray" are used interchangeably and infer a particular configuration which in the preferred configuration has an upwardly and outwardly flaring peripheral sidewall to hold the product In accordance with a second aspect of the invention, the aforementioned bowl or cradle is joined in laterally stable nesting association with a drink cup lid having suitable topographical features so as to complementally receive the bowl or cradle. A food product such as a donut is placed in the cradle after the lid and cradle have been joined. In the case of a drink cup which is filled with a hot drink such as coffee, the heat which rises from the hot drink is conducted through the lid and cradle bottom to the product where it warms the product in preparation for consumption.

It will be understood that the references to donuts and other food products herein are illustrative rather than limiting and that the invention may be used with a variety of vendible products.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENTS

Figure 1:
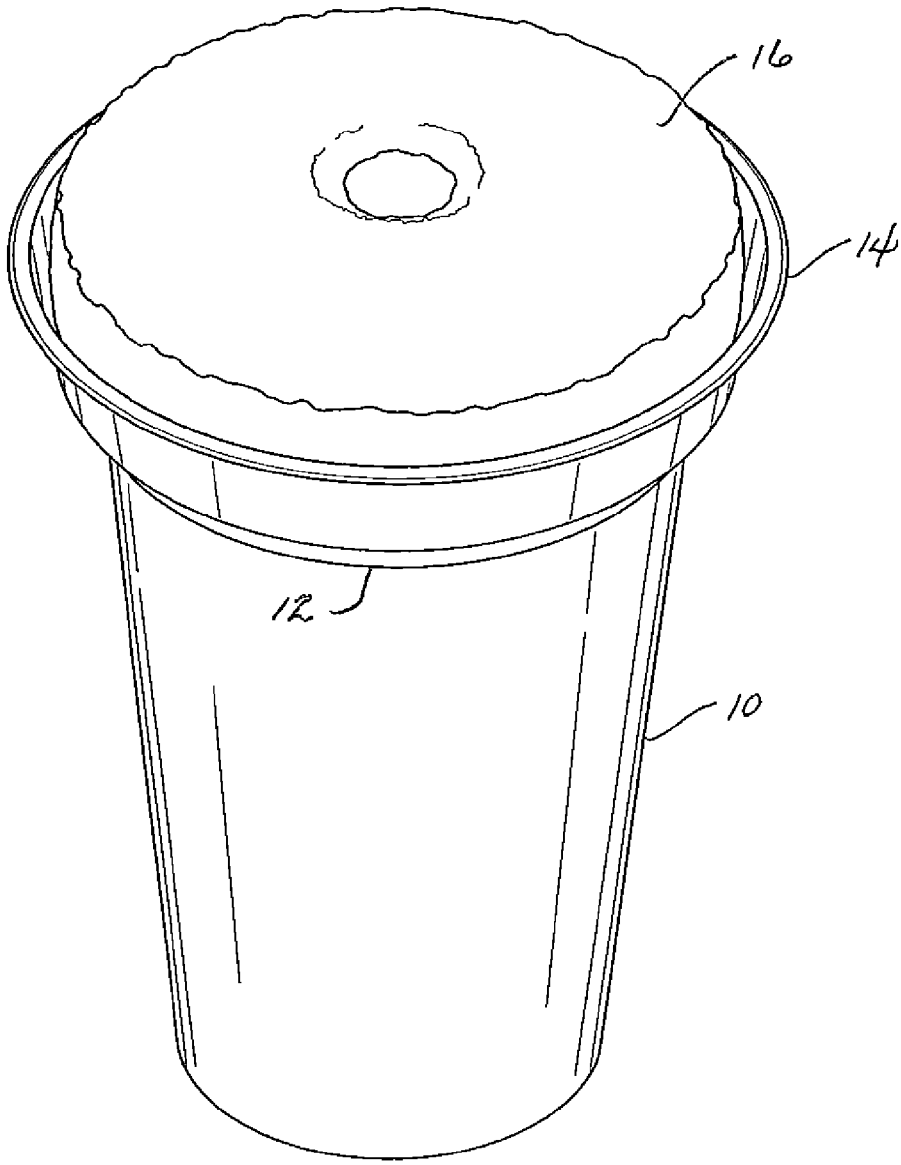
FIG. 1 is a perspective view of a hot cup, lid and donut cradle assembly according to the present invention.

FIG. 1 illustrates a conventional coated paper drink cup 10 of tapered cylindrical configuration and of such size and construction as to be typical of drink cups distributed by fast food restaurants and coffee shops throughout the United States and many other countries of the world. The cup 10 is, for example, of coated paper construction with a rolled rim and often finished with printing in decorative designs and/or commercial logos. FIG. 1 further illustrates a thermoformed plastic disposable drink cup lid 12 on the cup 10 and, in accordance with the invention, a thermoformed plastic cradle 14 which interfits with the lid 12 to provide lateral stability and which is configured and sized to receive therein a baked pastry 16, in this case, a donut.

Figure 2:
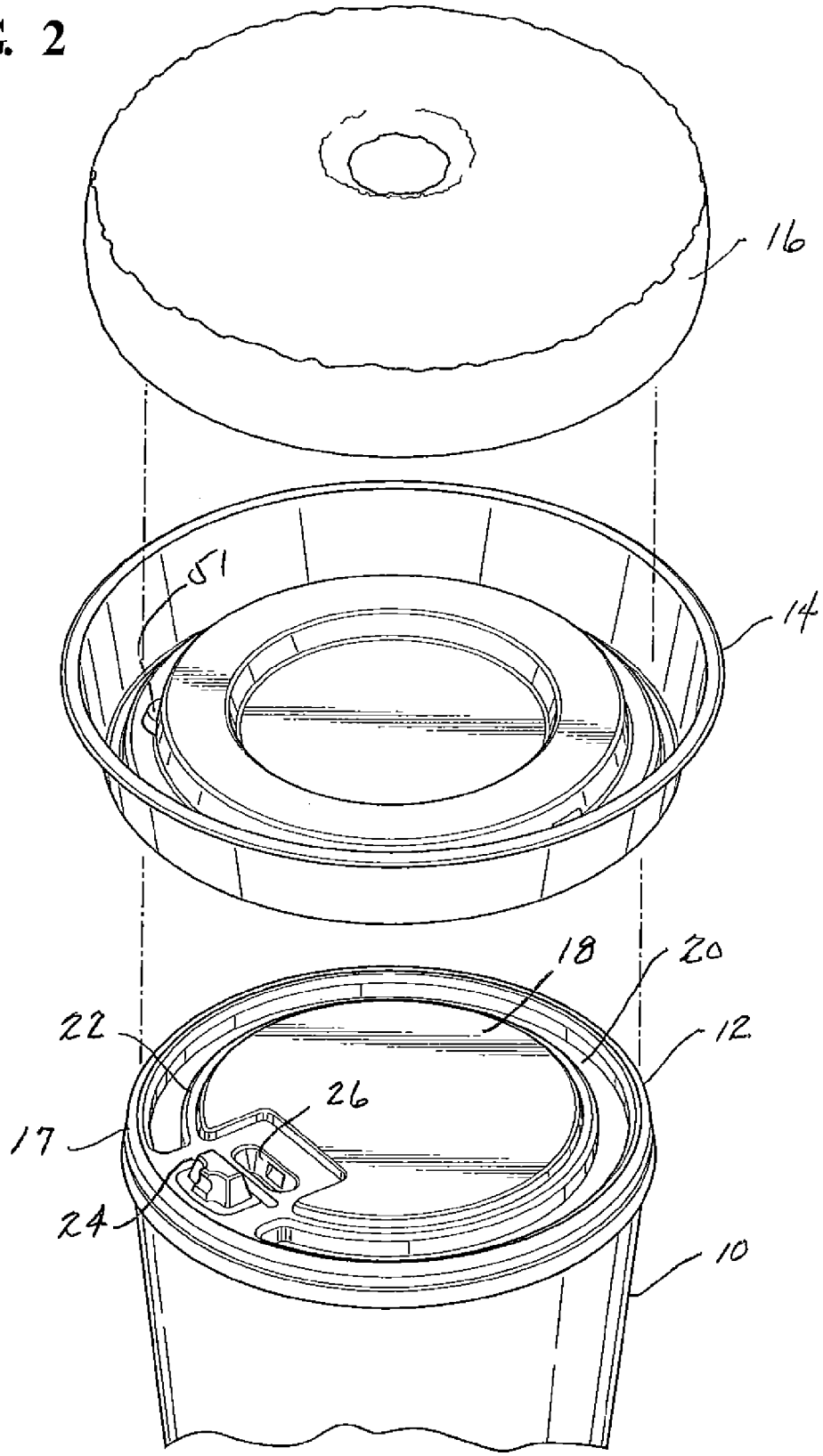
FIG. 2 shows the assembly of FIG. 1 exploded to reveal details of the components thereof.
Figure 3:
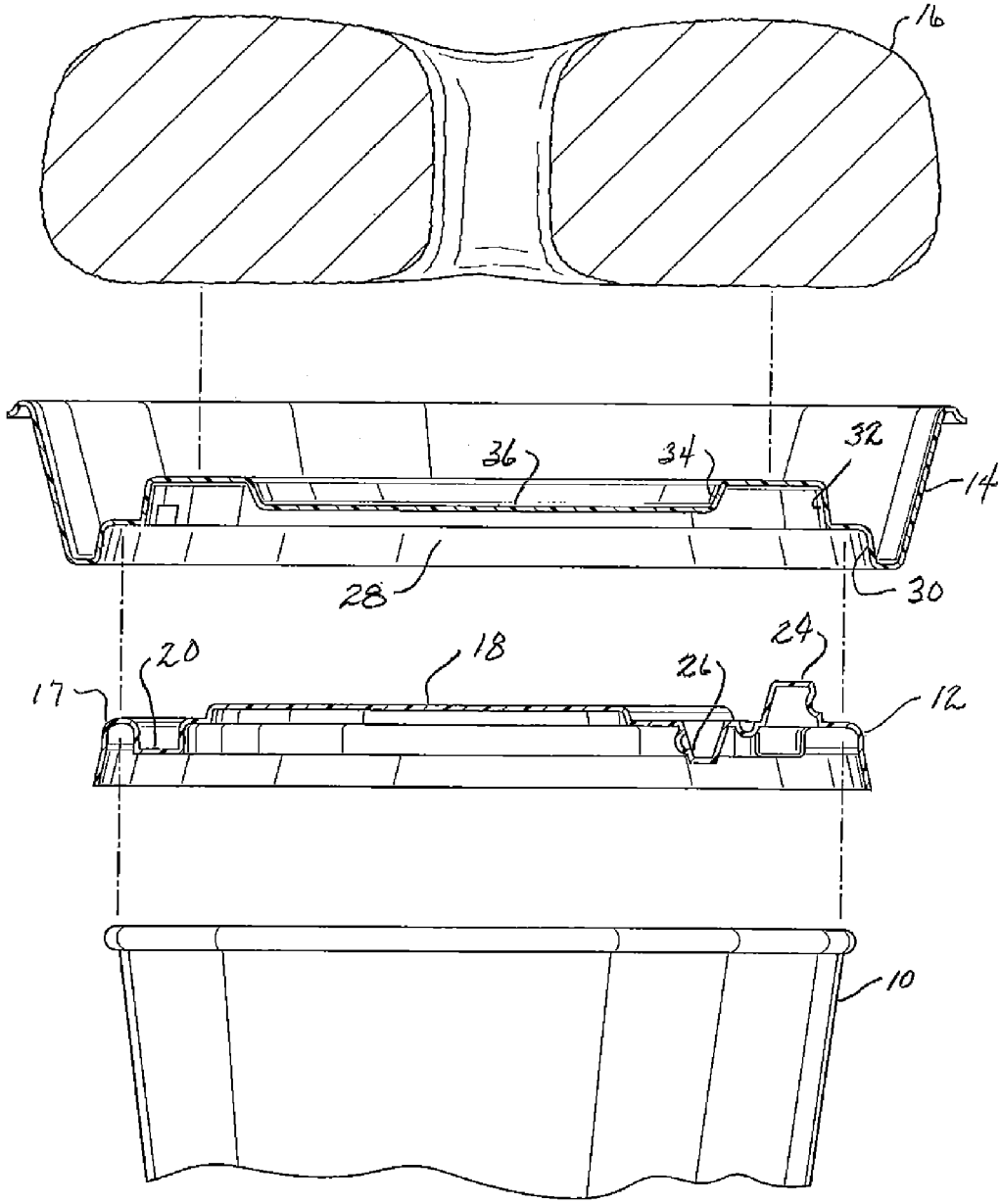
FIG. 3 is a side view in section of the exploded combination of FIG. 2.
Figure 4:
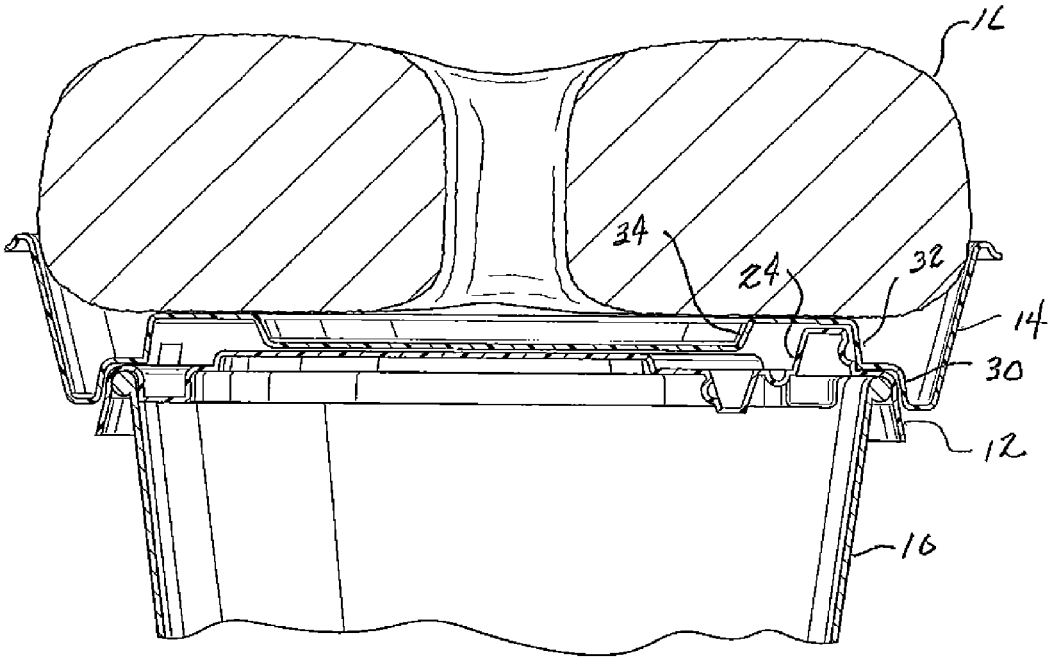
FIG. 4 is an assembled side sectional view of the embodiment of FIGS. 1 through 3.

Referring to FIGS. 2 through 4, the assembly of FIG. 1 is shown in greater detail. The lid 12 in this embodiment has a center deck 18 which is essentially flush with the rim 17 but separated from the rim 17 by a circular recess 20 which defines a step 22 between the recess and the center deck 18. In this Specification, the term "circular" is used to include not only full circles but also annular and semi-annular structures and/or configurations.

The lid 12 further comprises a fold-back tab 24 which cooperates with a well 26 to produce a lock-back feature so that the consumer may, after operating the tab 24, drink fluid from the cup 10 without removing the lid 12. Again, this is merely illustrative as the lid may have no drink-through feature or a simple aperture which is always open.

The lid 12 is preferably and typically made in a thermoforming operation wherein extruded sheet plastic material is fed onto a rotary drum containing dies which are perforated so that a vacuum can be pulled or drawn through the dies, thus causing the hot plastic sheet material to conform to the dies, thereby producing the desired topographical features of the lids 12. After forming, the lids are die-cut and packed in boxes for shipment to end users.

As shown in the drawings, the cradle 14 is essentially bowl-shaped and has a bottom recess 28 defining an outer circular step 30 and an intermediate circular step 32. A reverse step 34 defines a central deck 36 as best shown in FIG. 4. The bottom recess 28 of the cradle 14 is such as to be nestable in complemental relationship with the topographical features of the lid 12 such that the step 30 rests against the outer rim 17 of the cup lid to produce lateral stability between the lid 12 and the cradle 14. The intermediate step 32 provides an annular recess which accommodates the raised tab 24. The bottom deck 36 of the cradle 14 rests against or nearly against the deck 18 and the lid 12 so as to permit heat to be transferred from the hot contents (not shown) of the cup 10 through to the donut 16 which is placed within the side walls of the cradle 14.

Figure 5:
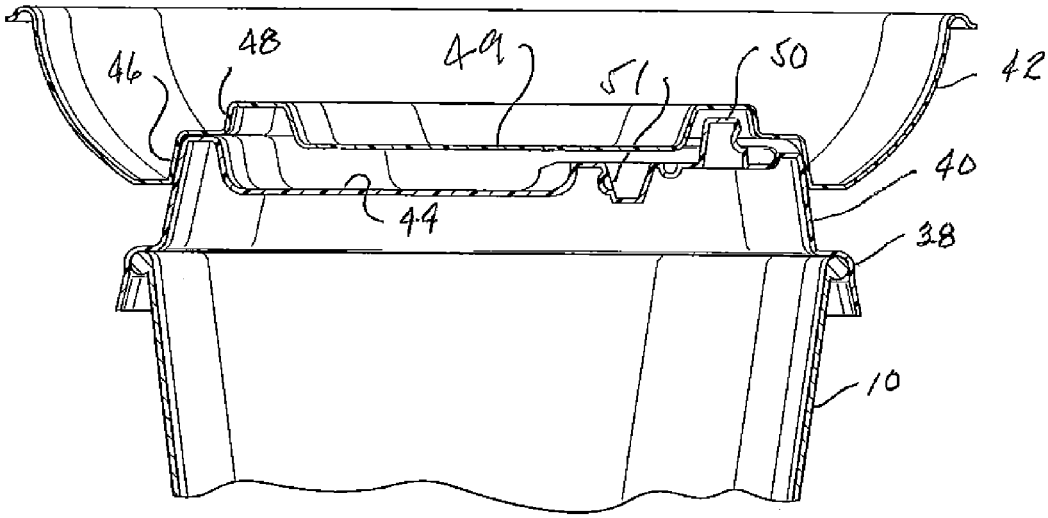
FIG. 5 is a side sectional view of a second embodiment of the invention.
Figure 6:
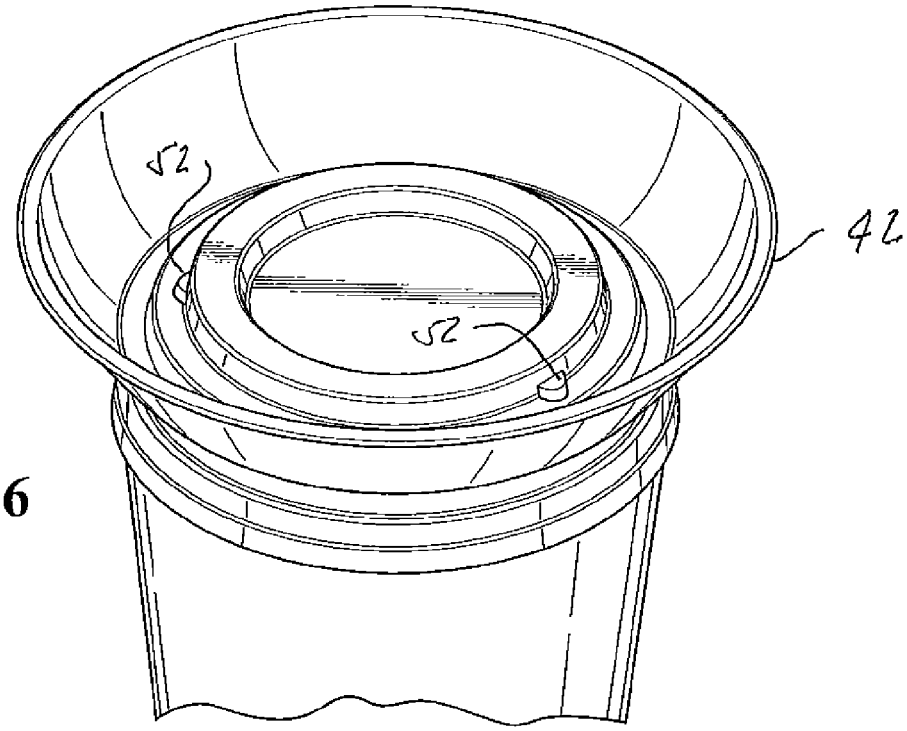
FIG. 6 is an assembled view of the embodiment of FIG. 5.
Figure 7:
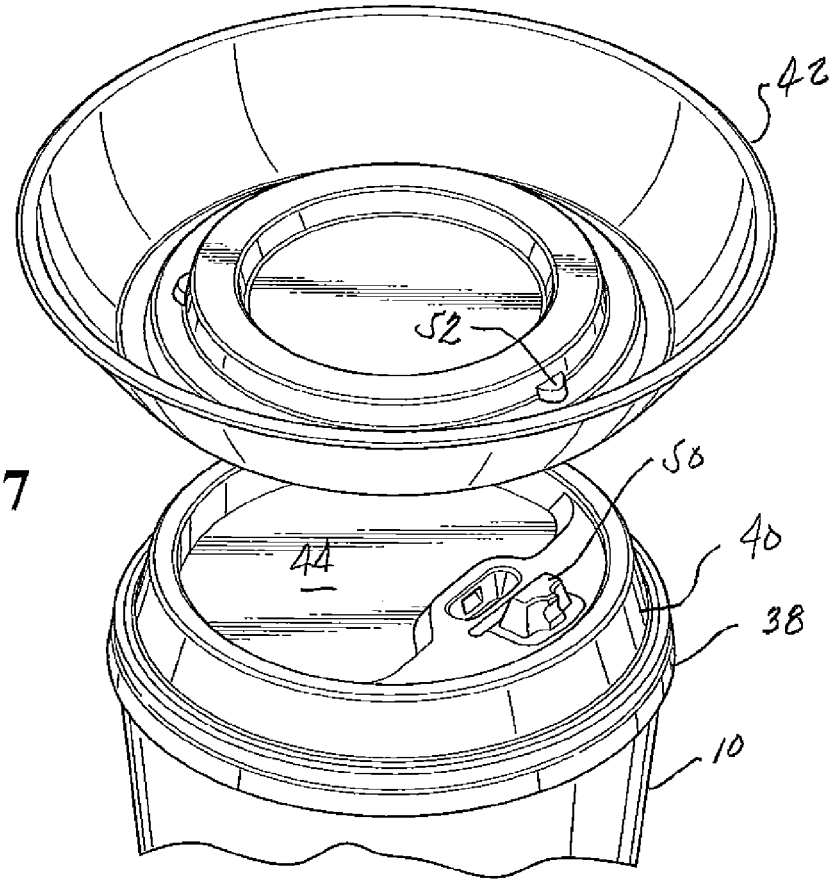
FIG. 7 is an exploded perspective view of the embodiment of FIG. 5.

Referring to the FIGS. 5 through 7, a similar embodiment is shown to comprise the cup 10, a domed "cappuccino" lid 38 and a flared bowl-shaped cradle 42 which is contoured to nest in complemental and laterally stable relationship with the lid 38 as best shown in FIG. 5.

The lid 38 has a raised and inwardly tapered step 40 within which is located a raised fold-back, lock-back tab 50 which can be locked into a well 51. A center deck 44 is recessed within the volume created by the high step 40.

The bowl or cradle 42 has a recessed bottom with an outer annular step 46 and an inner annular step 48 defining a central deck or bottom surface 49. In the complementally joined configuration as shown in FIG. 5, the step 46 of the cradle 42 nests against the outer surface of the step 40 of the lid 38 thereby to create lateral stability. The inner step 48 creates a clearance for the raised fold-back, lock-back tab 50. Once again, the donut 16 can be placed within the bowl-shaped cradle 42 to be warmed by the hot liquid in the cup 10.

In the embodiment of FIG. 5, outside diameter of the cradle is approximately 4.7 inches and the overall depth of the cradle is approximately 0.83 inches. The dimension from the top rim or edge of the cradle to the first innermost surface 49 is approximately 0.44 inches and the height between the bottom of the cradle 42 and the top of the first step 46 is approximately 0.22 inches. These dimensions are given by way of example and are not to be construed in a limiting sense. Materials of construction include polystyrene, polyethylene, polypropylene and other meltable, extrudable plastics well known in the art.

As shown in FIGS. 6 and 7, lugs 52 are molded into the inner step 48 of the cradle 42 in randomly arranged circumferentially spaced relationship so as to prevent full nesting of the thermoformed plastic cradles 42 when they are stacked one inside of the other for shipment. These lugs prevent the full nesting which would otherwise make it difficult to separate the cradles at the point of use. Similar lugs 51 are molded into the inside step of the cradle 14, as shown in FIGS. 1 through 3. The random location of these lugs is created when the dies for the trays or cradles are made, the random locations being such that no two cradles in a sequentially deployed die set are exactly alike insofar as the location of the lugs 51, 52 are concerned. When packed for shipment, the displaced lugs keep the cradles from resting too tightly due to road vibration and the like.

As indicated above, while the invention is believed to be particularly useful in combination with the marketing of pastry, such as donuts, the invention may be used in connection with marketing any of a variety of products in combination with drink cups with lids, whether containing hot, cold or room temperature materials or products. Further, while the illustrative embodiments include a cradle with a bottom concavity to receive a lid, the nesting relationship which provides lateral stability can also be achieved in an arrangement where the lid has a concave topography and the cradle plugs into it.

What is claimed is:

1. A cradle for use in nesting relationship with a disposable hot cup lid having multiple level topographical features, said cradle comprising a bowl-shaped molded plastic body having a continuous, aperture-free bottom surface contoured to nest with said topographical features and an upwardly and outwardly flaring sidewall integral with said bottom and of sufficient depth for holding within said sidewall a generally donut-shaped food product which is wider than said hot cup lid, said bottom having formed therein a recess with at least one upwardly extending step which extends concentrically upwardly into the center of the bowl-shaped cradle to receive therein a disposable hot cup lid.

2. A cradle as defined in claim 1 further including spacer lugs formed in a top interior surface of said step on the interior of said cradle adjacent but interior of one of the steps to serve to space the cradles apart when stacked.

3. A cradle as defined in claim 1 wherein said bottom has two concentric upwardly extending steps.

4. A cradle as defined in claim 1 wherein the cradle has an overall diameter of about 4.7".

5. A food service assembly comprising:

a disposal plastic lid adapted to fit onto a drink cup, said lid having an outer diameter and an outwardly-facing circumferential surface; and a bowl-shaped food product cradle adapted to be stacked on top of said lid; said upwardly and outwardly flaring sidewall having a depth sufficient to receive and hold therewithin a generally donut-shaped food product; said cradle having an aperture-free bottom surface and an upwardly and outwardly flaring sidewall terminating in a peripheral rim having a diameter at least as large as the outer diameter of said lid;

said bottom having formed therein a first upwardly extending recess defining an inwardly facing circumferential step surface that is placed in surface-to-surface contact with the outwardly-facing circumferential surface of said lid when said lid and cradle are stacked.

6. An assembly as defined in claim 5 wherein the cradle bottom has formed therein a second upwardly-extending recess concentric with the first upwardly-extending recess.

7. An assembly as defined in claim 6 wherein the lid has a topographical feature that is received into said second recess when said lid and cradle are stacked.

8. The assembly of claim 7 wherein the topographical feature is a pull-back tab.

9. The assembly defined in claim 5 wherein the cradle is made of thermoformed plastic and is approximately 3-5" in diameter.

10. An assembly as defined in claim 5 wherein the lid has a peripheral lip sized to fit over a drink cup rim and a domed top forming said circumferential surface.

11. A food product cradle adapted to be stacked on top of a disposal drink cup with a disposal plastic lid attached thereto wherein the cradle comprises:

a bowl-shaped body having a continuous, aperture-free bottom and an upwardly and outwardly flaring sidewall terminating in a peripheral rim and of sufficient depth to hold a generally donut-shaped food product therewithin, said bottom having formed therein first and second upwardly-extending concentric recesses defining first and second generally parallel, concentric inwardly-facing surfaces of different diameters.

12. A food product cradle as defined in claim 11 wherein said cradle is made entirely of thermoformed plastic.

* * * * *